United States Patent [19]

Duchemin

[11] 4,054,247

[45] Oct. 18, 1977

[54] DEVICE FOR ELASTICALLY FASTENING A RAIL ON ITS SUPPORTS

[75] Inventor: Michel Duchemin, Lambres les Douai, France

[73] Assignee: Ressorts du Nord S.A., Paris, France

[21] Appl. No.: 619,465

[22] Filed: Oct. 3, 1975

[30] Foreign Application Priority Data

Oct. 11, 1974 France ..... 74.34234

[51] Int. Cl.[2] ..... E01B 9/30

[52] U.S. Cl. ..... 238/349

[58] Field of Search ..... 238/310, 338, 349, 351

[56] References Cited

U.S. PATENT DOCUMENTS

| | | | |
|---|---|---|---|
| 2,608,123 | 8/1952 | Israelson | 238/349 X |
| 3,796,369 | 3/1974 | Faville | 238/349 |
| 3,799,437 | 3/1974 | Scherbaum | 238/349 |

FOREIGN PATENT DOCUMENTS

| | | | |
|---|---|---|---|
| 648,369 | 7/1937 | Germany | 238/349 |
| 522,414 | 6/1940 | United Kingdom | 238/349 |

*Primary Examiner*—Robert J. Spar
*Assistant Examiner*—Randolph A. Reese
*Attorney, Agent, or Firm*—Burns, Doane, Swecker & Mathis

[57] ABSTRACT

Device for elastically fastening a rail on its supports comprising at least two fasteners each of which has a clamping member extending therethrough. The fasteners are disposed parallel to the rail on each side of the latter. They comprise a spring strip which has in the free state one of its edges bent and bearing at its two ends on the edge of the flange of the rail. The arrangement of the fastener permits resolving all the problems of flexibility and clamping force. The device according to the invention can be employed for fastening railway rails to all supports.

10 Claims, 3 Drawing Figures

DEVICE FOR ELASTICALLY FASTENING A RAIL ON ITS SUPPORTS

The present invention relates to elastically yieldable fasteners for fastening a rail on its supports.

It is necessary for the good performance of railway tracks that the rails be tightly clamped on each support with a force which remains constantly high notwithstanding the vibrations and high stresses to which they are subjected upon passage of trains.

Also, it is necessary that the force be applied by a rather large surface so that the unit pressure on, and therefore the wear of, the rail remains low.

For this purpose usually the rail is clamped on each of its supports by means of fasteners comprising a spring strip disposed perpendicular to the rail and bearing, at one end, against the flange of the rail and, at the other end, against its support. Between the two ends, the spring strip is provided with an aperture for the passage of the shank of the clamping means such as a bolt or coach-screw.

This clamping means is anchored in the support of the rail and has a head which exerts a force on the strip.

In order to avoid the tilting of the rail, the clamping means must be anchored very near to the flange of the rail. It sometimes happens that there is insufficient length to enable the spring strip to have the required elasticity.

It has been envisaged to increase this elasticity by the use of fasteners formed by metal strips which are disposed parallel to the rail and bear against the latter at their two ends, each strip being maintained by clamping means anchored on the support. Unfortunately, the force exerted by the fastener on the clamping means has been found to be excessively high so that the clamping means rapidly deteriorates or, when the support is of wood or like material, it is torn away from the support which is also damaged.

An object of the present invention is to overcome these drawbacks by providing a device for fastening a rail to its support which has high elasticity enabling it to ensure a constantly high clamping without producing a great tilting torque in the clamping means and can thus be employed irrespective of the nature of the support.

According to the invention, there is provided a device for fastening a rail to a support, comprising at least two fasteners which are disposed on each side of the rail and are each maintained, by clamping means, in bearing relation to the flange of the rail and to the support, wherein each of the fasteners comprises a spring strip, one of the longitudinal edges of which strip is bent in the free state and bears at its ends on the flange of the rail whereas the other longitudinal edge of the strip bears at at least one point on the support, the clamping means extending through the center of the strip.

The edge of the strip which bears against the flange of the rail may be as long as required and it fully contributes to the elasticity of the fastener owing to its bent shape and to the fact that, in the free state, it bears on the rail only at the ends of the strip.

When the fastener is pressed down by the clamping means, the surface of contact with the rail increases; if need be, the edge may be applied against the flange of the rail throughout its length with a substantially constant pressure.

The edge of the strip which bears against the support has a dimension and shape adapted to the support. It may be bent in the same way as the edge bearing against the flange of the rail and have the same length as this edge, but it may also be much shorter and constitute a center single bearing tab which still further increases the clamping effect on the flange.

Features and advantages of the invention will be apparent from the ensuing description of embodiments given by way of examples with reference to the accompanying drawings in which.

Figure 1:
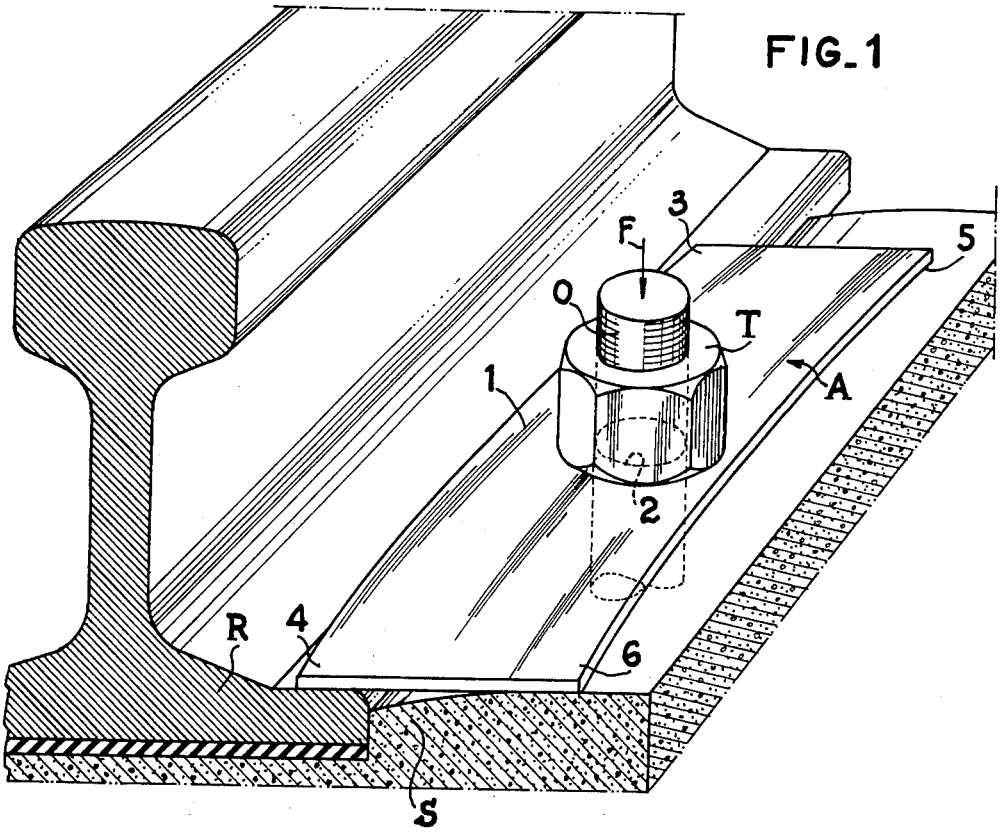
FIG. 1 is a partial perspective view of a rail fastening device according to the invention.

With reference first to FIG. 1, the device for fastening a rail to its support comprises two identical fasteners fixed in the same way on each side of the rail, only one of these fasteners A being shown in this Figure and being described in detail.

This fastener A is constituted by a spring strip 1 having a constant thickness and provided with an aperture 2 at its center. The strip is slightly bent in the longitudinal direction, its concavity facing downwardly, that is to say toward the flange R of the rail and towards the support S of this rail. This strip 1 bears, on one of its longitudinal edges, against the flange of the rail R and on its other longitudinal edge against the rail support S and is maintained by a clamping means 0 which extends through the aperture 2 and is anchored in the support S.

In the free state, the strip bears against the rail and against the support only at its ends. The corners 3 and 4 bear against the rail R and the corners 5 and 6 against the support S of the rail.

When the head T of the clamping means exerts a force F on the fastener A, it straightens elastically and at each end its surface of contact with the rail increases. In the extreme state, it comes in contact with the flange of the rail R throughout its length. Likewise, the surface of contact with the support S increases with the clamping force and may extend throughout the length of the longitudinal edge of the strip.

Upon passage of trains on the track, the rail R is subjected to high stresses and forces which compress its supports S. The rail R descends a little. Owing to its elasticity, the fastener A slightly resumes its initial bent shape and thus exerts its force against the edge of the flange in a continuous manner.

The rail R is not always inserted in its support S as shown in FIG. 1. For example, it can be placed on a flat support $S_1$ as shown in FIG. 2.

Each fastener $A_1$ is then constituted by a strip 11 which is provided at its center with an aperture 12 for the passage of a clamping means 0 and has a longitudinal edge 13 bearing against the flange R of the rail. This edge is bent in the free state and has its concavity facing the rail. The second longitudinal edge 15 of the strip 11 is preferably flat and pressed-formed at each end to constitute feet or tabs 15, 16 which bear against the support $S_1$ and compensate for the different levels of the flange R and the support $S_1$.

As in the embodiment shown in FIG. 1, the clamping force exerted by the means 0 is distributed between these two edges, that is to say between the rail flange and the rail support and there is no tilting torque to tend to deteriorate or tear the clamping means away from the support.

Figure 2:
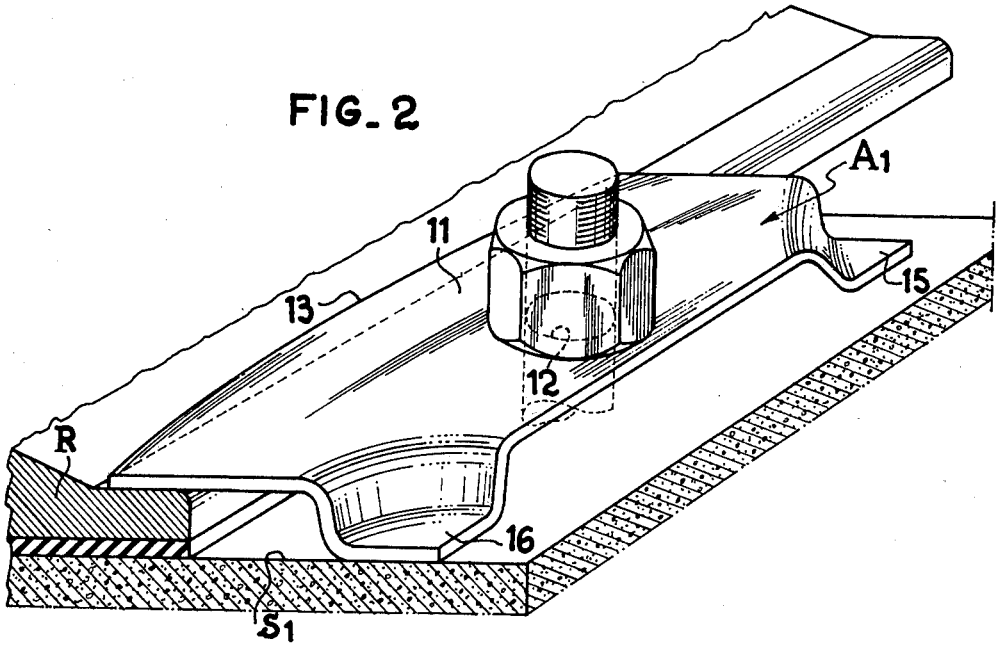
FIGS. 2 and 3 are perspective views of modifications of the fastener of the device shown in FIG. 1.

Although the strips 1 and 11 shown in FIGS. 1 and 2 have a rectangular shape, this shape is not essential and the strips may have, for example, a trapezoidal shape.

The longitudinal edge 3–4 or 13 bearing against the flange, which fully contributes to the elasticity of the fastener, can thus be as long as required and receive the required curvature, the longitudinal edge opposite thereto, which does not contribute to the elasticity, having a shorter length adapted to the dimension of the support S which is often formed by a sleeper or tie of concrete or wood.

Figure 3:
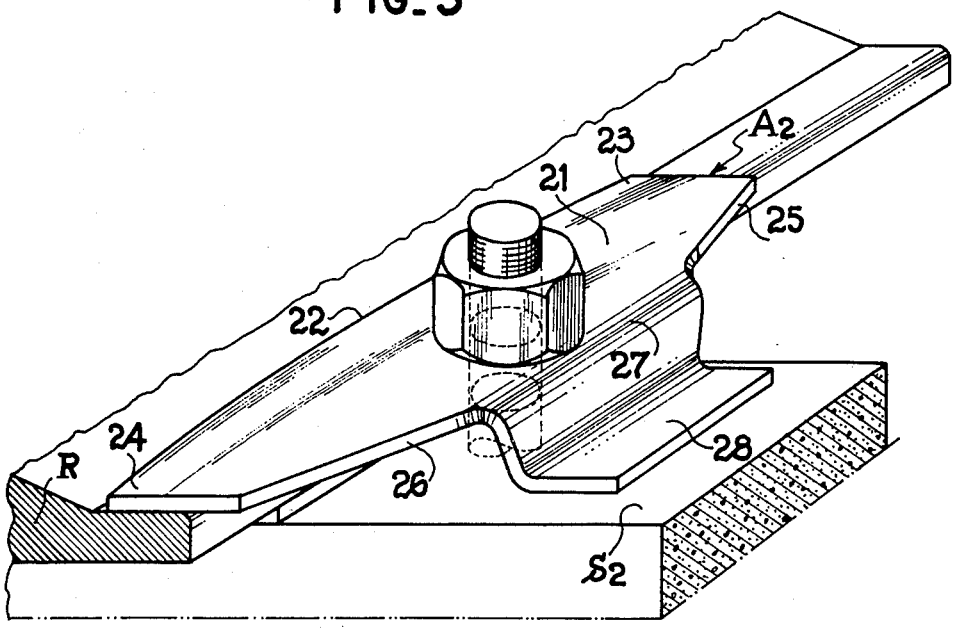

As shown in FIG. 3, a fastener $A_2$ may thus be longer than the support $S_2$ of the rail, or the part of the support of the rail on which the fastener $A_2$ can bear. The strip 21 which constitutes this fastener is then cut away at 25 and 26 on each side of its center part 27 so as to constitute a lateral foot or tab 28 bearing against the support $S_2$ of the rail and of relatively short length. In FIG. 3, this length is, for example, less than $\frac{1}{3}$ of the length of the edge 22 bearing against the flange of the rail R.

In this case the clamping means is preferably adjusted in such manner that the edge 22 is applied against the flange of the rail R by two distinct surfaces 23 and 24 without attaining contact with the rail flange throughout the length of the edge 22. The clamping force is then distributed between the two surfaces of contact with the flange and the surface of the tab 28 which bears against the support $S_2$. As the clamping means is at the center of the strip 21, the three surfaces 23, 24 and 28 are at equal distance from this means. The force exerted on the flange of the rail is therefore double that exerted on the support. The latter force is sufficient to avoid the creation of a tilting torque on the clamping means whereas the effectiveness of the device is considerably increased owing to the high value of the ratio between the flange clamping force and the clamping force exerted on the support.

It will be understood that the tab 28 may be either exactly in the extension of the strip 21 or offset in height (FIG. 3) in the same manner as the tabs 25 and 26 of the strip 11, depending on the position of the flange of the rail R with respect to its support.

The width of the strip 1, 11 or 21 can be relatively small since the clamping means may be as close as possible to the flange of the rail R without danger of adversely affecting the elasticity of the fastener.

Such a device may therefore be employed whenever it is desired to fasten a rail to a sleeper or tie or other support and it is desired to obtain high elasticity of the fastener and/or a high ratio between the clamping force exerted on the rail and the force exerted by the clamping means on the support, irrespective of the nature of this support and even if the flange of the rail is narrow or encumbered by other means, for example fishplates.

Having now described my invention what I claim as new and desire to secure by Letters Patent is:

1. A structure comprising in combination a railway track rail having a flange, a support for the rail and a device for fastening the rail to the support, the device comprising at least two fasteners which are disposed on opposite sides of the rail and clamping means for maintaining each fastener, each of the fasteners comprising a spring strip having a first edge which is rectilinear in plan substantially throughout the extent of the spring strip longitudinally of the rail and extends in a direction parallel to the rail and a second edge which is opposed to the first edge transversely of the rail, the strip being, in a free unstressed state of the strip, bent on and alongside said first edge and bearing at ends of the first edge on the flange of the rail and bearing on the support in at least one part of the strip adjacent the second edge, the clamping means extending through the center of the strip, the spring strip being capable of being clamped down by the clamping means so that said first edge can assume a position flat against the rail flange, and the strip being, in the intended state of the structure for fastening the rail, put in a clamped down and stressed state by the clamping means and having its initially bent first edge applied on the flange of the rail substantially throughout the length of said first edge.

2. A structure as claimed in claim 1, wherein the spring strip has a constant thickness and is substantially planar in said clamped stressed state.

3. A structure as claimed in claim 2, wherein the spring strip is in said free state a portion of a cylinder bearing at each end partly on the flange of the rail and partly on the support.

4. A structure as claimed in claim 2, wherein the strip is rectangular in plan.

5. A structure as claimed in claim 1, wherein said spring strip includes two tabs which are adjacent two ends of said second edge and bear on the support.

6. A structure as claimed in claim 5, wherein the tabs constitute bearing surfaces parallel to the plane of the strip in the clamped stressed state of the strip in the vicinity of said second edge but offset with respect to said plane.

7. A structure as claimed in claim 1, wherein said first edge is longer than said second edge of the strip.

8. A structure as claimed in claim 7, wherein the second edge is short and located at the same distance from the clamping means as two surfaces of the strip which are adjacent said ends of the first edge and bear on the flange of the rail so that the clamping force is equally distributed among three bearing regions.

9. A structure as claimed in claim 8, wherein said second edge defines a lateral substantially planar tab bearing flat on the support, the strip having a substantially vertical step portion disposed between said tab and a portion of the strip located immediately under the clamping means on a side of the clamping means remote from the rail.

10. A structure comprising in combination a railway track rail having a flange, a support for the rail and a device for fastening the rail to the support, the device comprising at least two fasteners which are disposed on opposite sides of the rail and clamping means having a substantially vertical axis for maintaining each fastener, each of the fasteners comprising a spring strip having an aperture substantially centered on said axis of the clamping means and disposed substantially half-way between ends of the strip longitudinally of the rail, the strip having a first edge which is rectilinear in plan substantially throughout the extend of the spring strip longitudinally of the rail and extends in a direction parallel to the rail and a second edge which is opposed to the first edge transversely of the rail, the strip being, in a free unstressed state of the strip, bent on and alongside said first edge and bearing at ends of the first edge on the flange of the rail and bearing on the support in at least one part of the strip adjacent the second edge, the clamping means extending through the aperture of the strip, the spring strip being capable of being clamped down by the clamping means so that said first edge can assume a position flat against the rail flange and the strip being, in the intended state of the structure for fastening the rail, put in a clamped down and stressed state by the clamping means and having its initially bent first edge applied on the flange of the rail substantially throughout the length of said first edge, and the first edge of the strip having a length which is greater than the overall dimension of the strip in plan in a direction perpendicular to the rail, and the strip having a median portion which extends in at least a major part of the length of the strip longitudinally of the rail and extends transversely of the rail from said first edge to beyond said aperture of the strip and defines in the free unstressed state of the strip a curved surface having generatrices extending transversely of the rail in plan view.

* * * * *